US009884234B1

(12) United States Patent
Fischer

(10) Patent No.: US 9,884,234 B1
(45) Date of Patent: Feb. 6, 2018

(54) AERODYNAMIC GOLF CLUB

(71) Applicant: Alan Fischer, Palm Beach Gardens, FL (US)

(72) Inventor: Alan Fischer, Palm Beach Gardens, FL (US)

( * ) Notice: Subject to any disclaimer, the term of this patent is extended or adjusted under 35 U.S.C. 154(b) by 0 days.

(21) Appl. No.: 15/171,142

(22) Filed: Jun. 2, 2016

(51) Int. Cl.

| | |
|---|---|
| ***A63B 53/02*** | (2015.01) |
| ***A63B 60/52*** | (2015.01) |
| ***A63B 53/00*** | (2015.01) |
| ***A63B 53/04*** | (2015.01) |
| *A63B 60/00* | (2015.01) |

(52) U.S. Cl.
CPC ..... *A63B 60/52* (2015.10); *A63B 53/007* (2013.01); *A63B 53/0487* (2013.01); *A63B 2053/0441* (2013.01); *A63B 2060/006* (2015.10)

(58) Field of Classification Search
CPC ..... A63B 60/52
See application file for complete search history.

(56) References Cited

U.S. PATENT DOCUMENTS

| | | | | | |
|---|---|---|---|---|---|
| 1,697,846 | A | * | 1/1929 | Anderson | A63B 53/06 473/246 |
| 3,003,768 | A | | 10/1961 | Clements | |
| 3,468,544 | A | | 9/1969 | Antonious | |
| 3,794,328 | A | | 2/1974 | Gordon | |
| 4,065,133 | A | * | 12/1977 | Gordos | A63B 53/04 473/327 |
| 4,809,982 | A | | 3/1989 | Kobayashi | |
| 4,898,387 | A | | 2/1990 | Finney | |
| 4,964,639 | A | * | 10/1990 | Tucker | A63B 53/007 473/255 |
| 5,078,398 | A | | 6/1992 | Reed et al. | |
| 5,158,296 | A | | 10/1992 | Lee | |
| D353,176 | S | * | 12/1994 | Poggi | D21/733 |
| 5,454,784 | A | | 10/1995 | Atkinson et al. | |
| 5,524,890 | A | | 6/1996 | Kim et al. | |
| 5,529,303 | A | | 6/1996 | Chen | |
| 5,681,227 | A | | 10/1997 | Sayrizi | |
| 5,695,409 | A | | 12/1997 | Jackson | |
| 5,807,187 | A | | 9/1998 | Hamm | |
| 6,165,080 | A | | 12/2000 | Salisbury | |

(Continued)

*Primary Examiner* — Michael Dennis
(74) *Attorney, Agent, or Firm* — Thomas L. Adams

(57) ABSTRACT

An aerodynamic golf club has a club head connected to an elongated shaft. The club head has a central section and contiguous thereto, a separated pair of flanking sections on opposite sides of the central section. The central section has a striking face in front and a rear surface in back. The pair of flanking sections each has a leading face in front and a trailing surface in back. The leading face of each of the flanking sections has a plurality of inlets. The trailing surface of each of the flanking sections has a plurality of outlets. Each of the flanking sections has a plurality of distinct channels. Each of the channels runs from a corresponding one of the plurality of inlets to an associated one of the plurality of outlets. The central section has an exposed top surface and an exposed bottom surface. Each of the top surface and the bottom surface extends up to the pair of flanking sections. The central section is impervious between its top surface and its bottom surface to internal airflow. The central section is impervious to internal airflow at the striking surface and above and below the striking surface.

20 Claims, 6 Drawing Sheets

(56) References Cited

U.S. PATENT DOCUMENTS

| | | | | |
|---|---|---|---|---|
| 6,471,602 | B1 | 10/2002 | D'Orazio | |
| 6,824,474 | B1 | 11/2004 | Thill | |
| 8,651,974 | B2 | 2/2014 | Guerriero | |
| 2010/0022325 | A1 | 1/2010 | Doran | |
| 2010/0304879 | A1* | 12/2010 | Bittner ..... | A63B 53/0487<br>473/253 |

* cited by examiner

AERODYNAMIC GOLF CLUB

BACKGROUND OF THE INVENTION

1. Field of the Invention

The present invention relates to golf clubs, and in particular, clubs with aerodynamic features for improving club performance

2. Description of Related Art

Traditional golf clubs have a solid club head connected to an elongated shaft. The club head has a striking face extending substantially from the toe to the heel of the club head (i.e. from the distal to the proximal end of the club head). Club heads are made with various masses and loft angles, depending upon the desired trajectory and distance.

When a golfer swings an iron or wood, the club head travels in an arc along an inclined plane. The face of the club tends to open on the backswing, close on the downswing, and then ideally strike the ball with the club face perpendicular to the desired flight path of the ball.

A putter head has a much more abbreviated travel path and some players advocate moving the putter head in an arc along an inclined plane so that the club face will again open and close, although the opening and closing will be much less pronounced. Other players advocate moving the putter head through a vertical plane, always keeping the face of the putter perpendicular to the desired trajectory of the ball.

With either of these putting techniques the striking face of the putter is substantially perpendicular to the travel path of the putter head, especially at the moment of ball impact. The same may be said for irons or woods except that the club face will be offset from perpendicular in accordance with the loft angle of the club.

In comparison to irons a woods, putters have relatively lighter heads and essentially no loft angle. Effective use of these putters requires extreme precision and consistency. The least variation in the orientation of the head of a putter can make the difference between sinking or missing a putt. Swinging golf clubs designed for greater distances (irons and woods) are equally challenging and also require extreme precision and consistency.

For this reason, much thought and research has gone into structuring the head of a golf club to ensure proper performance. Various physical features of a club head have been adjusted to optimize club performance. Important features in the design of a club head are weight, balance, center of gravity, size and shape of the striking surface, loft angle, moment of inertia, etc.

See also U.S. Pat. Nos. 3,003,768; 3,468,544; 3,794,328; 4,809,982; 4,898,387; 5,054,784; 5,078,398; 5,158,296; 5,524,890; 5,529,303; 5,681,227; 5,695,409; 5,807,187; 6,165,080; 6,471,602; 6,824,474; and 8,651,974, as well as U.S. Patent Application Publication No 2010/0022325.

SUMMARY OF THE INVENTION

In accordance with the illustrative embodiments demonstrating features and advantages of the present invention, there is provided an aerodynamic golf club. The golf club has a club head connected to an elongated shaft. The club head has a central section and contiguous thereto, a separated pair of flanking sections on opposite sides of the central section. The central section has a striking face in front and a rear surface in back. The pair of flanking sections each has a leading face in front and a trailing surface in back. The leading face of each of the flanking sections has a plurality of inlets. The trailing surface of each of the flanking sections has a plurality of outlets. Each of the flanking sections has a plurality of distinct channels. Each of the channels runs from a corresponding one of the plurality of inlets to an associated one of the plurality of outlets. The central section has an exposed top surface and an exposed bottom surface. Each of the top surface and the bottom surface extends out to the pair of flanking sections. The central section is impervious between its top surface and its bottom surface to internal airflow. The central section is impervious to internal airflow at the striking surface and above and below the striking surface.

By employing structure of the foregoing type, an improved golf club is provided that has enhanced aerodynamic characteristics. In a disclosed embodiment a club head has a solid central section flanked on opposite sides by sections having a number of parallel channels that open on opposite sides of the club head to allow air passage from the front to the back of the club head. In one embodiment the channels are straight bores with a circular cross-section. In another embodiment the channels are parallels slots extending horizontally, i.e. front to back and right to left. These channels stabilize the movement of the club head to allow more accurate and consistent ball impact and ball trajectory.

In such embodiments the tops of the flanking sections and the central section can be coplanar. In other embodiments the tops of those three sections can be parallel but with the top of the central section at a lower elevation.

In still other embodiments the flanking sections can have upper slanted faces that diverge upwardly and outwardly from the top of the central section. In one such embodiment an upper air conduit is mounted on the upper slanted faces of the flanking sections. These conduits each have an inside upright wall and a top wall to form with the slanted face a triangular passage. In a disclosed embodiment the conduits extend from the front of the flanking section halfway to the back. In some embodiments no further structure follows the conduits, while in other embodiments similar but smaller conduits communicate with and follow behind the front conduits.

In the disclosed embodiments, an elongated shaft is attached obliquely to the top of the central section. The top of the central section can also be marked with an optional trio of equidistantly spaced, parallel lines that run from front to back, at right angles to the striking face of the club head. The two outer lines represent the width of a golf ball and the centerline indicates the point of impact and the direction of travel by the golf ball. The underside of the club head can, if desired, be convexly curved from right to left (i.e. from one flanking section, past the central section, and to the other flanking section).

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
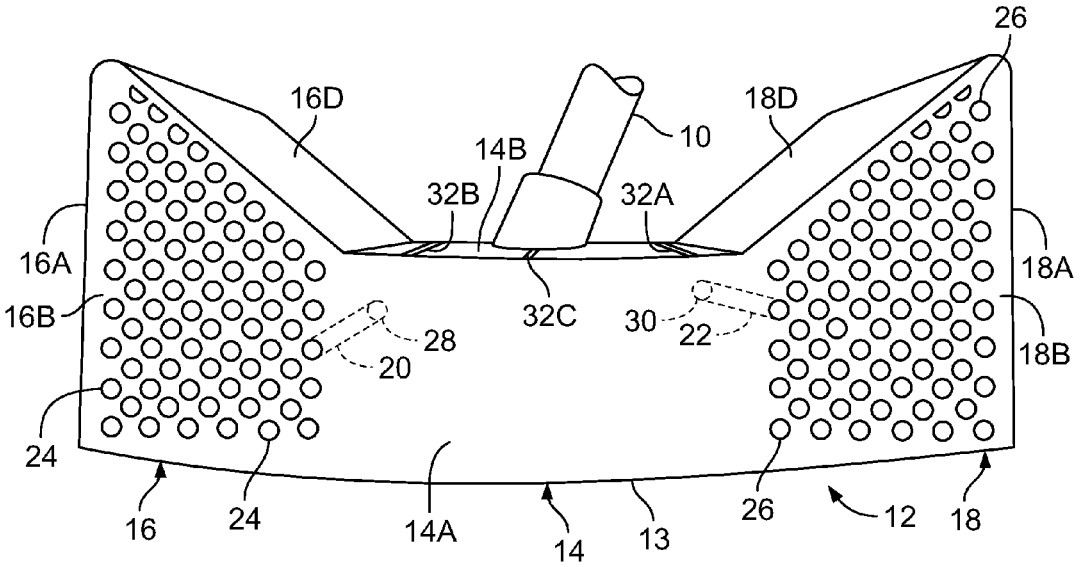
FIG. 1 is a front, perspective view of a golf club in accordance with principles of the present invention.
Figure 2:
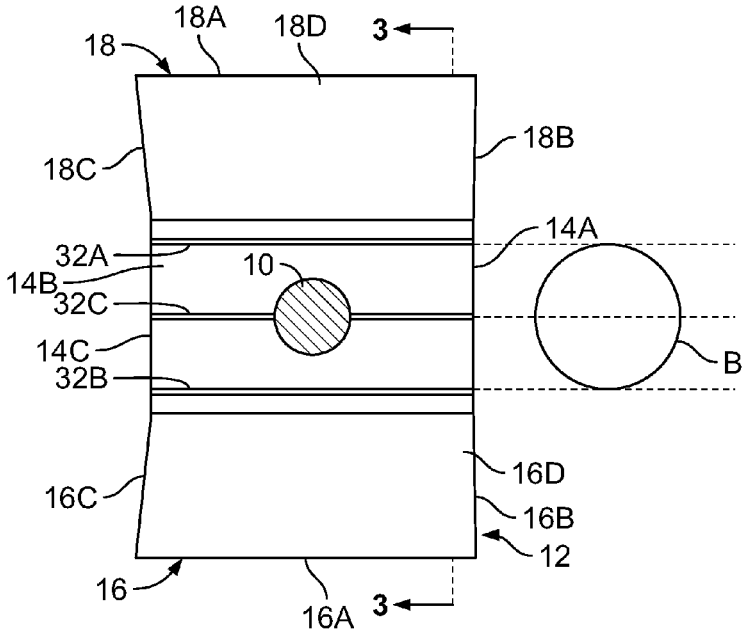
FIG. 2 is a top view of the golf club of FIG. 1.
Figure 3:
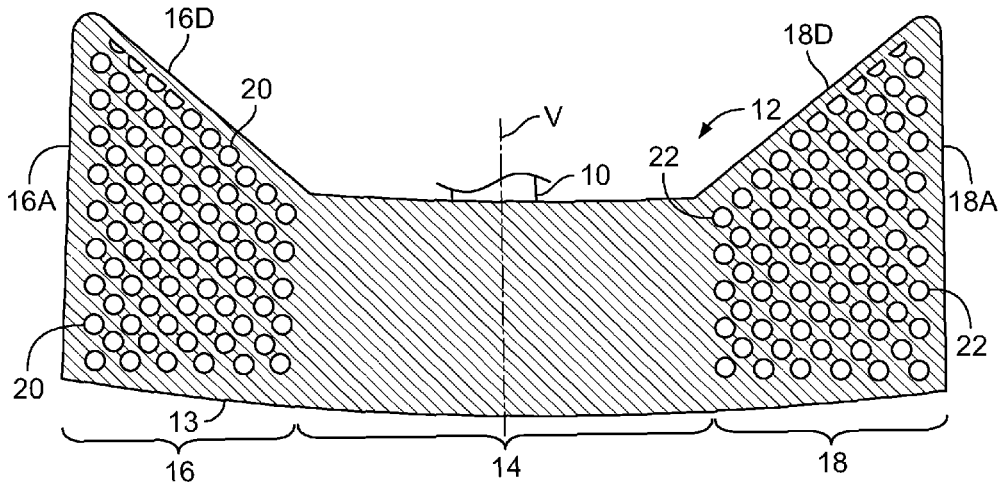
FIG. 3 is a vertical sectional view taken along line 3-3 of FIG. 2.

Referring to FIGS. 1-3, a golf club is shown with elongated shaft 10 attached at an angle to the top of club head 12 at section 14. Shaft 10 is, in this embodiment, an ordinary golf club shaft typically fitted on the distal end with a gripping sleeve (not shown). Shaft 10 is shown attached at the center of club head 12 (midway between the toe and heel of the club head), but in some embodiments may be offset from the center position. The bottom surface 13 of club head 12 is convexly curved in the toe to heel direction.

Club head 12 has a central section 14 that is flanked on opposite sides by integral flanking sections 16 and 18. Bottom surface 13 extends along sections 14, 16, and 18. The front of central section 14 has a striking face 14A that is wider than a golf ball. In this embodiment striking face 14A has a zero loft angle since this club head 12 is designed as a putter. Top surface 14B of central section 14 is marked with three parallel, equidistantly spaced indicia 32A, 32B, and 32C, which may be formed by inking, painting, engraving, etc. Indicia 32A and 32B are gauge marks that are spaced apart to represent the diameter of golf ball B, as shown in FIG. 2. Central indicia 32C is an alignment mark representing the center of striking face 14A and the expected direction of travel for golf ball B when struck.

Flanking section 16 (18) has a distal surface 16A (18A) that is upright in this embodiment Section 16 (18) has a leading face 16B (18B) in front, and a trailing surface 16C (18C) in back. Proximal surface 16D (18D) of section 16 (18) is slanted and upwardly diverges from central section 14. In this case flanking sections 16 and 18 are taller than central section 14. In this embodiment the boundary between flanking section 16 (18) and central section 14 is defined by a vertical surface containing the intersection of surface 14B and slanted surface 16D (18D).

Striking surface 14A and central section 14 may have dimensions similar to known putters. Central section 14 may take up around 30% to 60% of the overall width of club head 12. In this embodiment central section 14 has an overall height approximately half that of flanking sections 16 and 18, although in some embodiments the height of the flanking sections may range from the same height to as much as triple the height of the central section.

Surfaces 16A and 16D are disposed at an acute angle (in this case 50 degrees) and form a rounded corner as do surfaces 18A and 18D. Other than those rounded corners and the curved underside 13, flanking sections 16 and 18 are polyhedral. While the foregoing portions of sections 16 and 18 are polyhedral they need not be so, and in some embodiments the various surfaces need not be flat and may be convex, concave, or a combination of convex and concave, and the curvatures may be cylindrical, spherical, or some other complex curvature. In the illustrated embodiment, rear surfaces 16C and 18C obliquely intersect rear surface 14C of central section 14, although in other embodiments these rear surfaces may combine into one smooth surface that may be flat or curved in various ways.

In this embodiment front surfaces 14A, 16B, and 18B are coplanar. Good performance is achieved when striking surface 14A is flat. On the other hand, surfaces 16B and 18B need not be coplanar and in some embodiments may be skewed or curved in various ways.

The flanking sections 16 and 18 are perforated by a number of straight, parallel channels 20 and 22, respectively. Channels 20 (22) are uniform bores having round inlets 24 (26) that lead to round outlets 28 (30). Inlets 24 are arranged in a number of rows, successive rows being staggered. The bottom ten rows alternate between six and five inlets 24 for a total of 55 inlets. The remaining twenty four inlets 24 have a similar pattern except that the number of inlets per row diminishes because of the slanting of surface 16D. Because of the incursion of surface 16D, the four highest inlets 24 running along surface 16D are progressively truncated and their associated channels will be truncated cylinders having a D-shaped cross section.

Other than those four D-shaped channels, channels 20 (22) will be cylindrical with circular inlets 24 (26) and circular outlets 28 (30). In any event, in this embodiment channels 20 and 22 will have a constant cross-section throughout and will be perpendicular to striking surface 14A. It will be understood that channels 22 of section 18 are arranged as the mirror image of channels 20 of section 16. In fact section 18 is the mirror image of section 16.

In this embodiment the diameters of channels 20 and 22 are 3/16 inch (5 mm), although different diameters may be employed with a corresponding adjustment of the number and spatial density of the channels. When relatively small channels are employed they will be distributed with a plurality of them distributed horizontally and a plurality distributed vertically. In such arrangements it is desirable to have a reasonable number of channels, and good results are achieved when twenty or more channels are used in each flanking section. In this embodiment channels 20 occupy approximately 28% of the cross-sectional area of flanking section 16, and their inlets 24 and outlets 28 occupy approximately 28% of the area of surfaces 16B and 16C, respectively. Flanking section 18 has the same proportion of coverage. In other embodiments the channels and their inlets/outlets may occupy 20% to 75% of the associated cross-sectional area and surface area of the flanking sections.

Unlike flanking sections 16 and 18, central section 14 is distinguished by being impervious to internal airflow that could travel inside central section 14 from front to back. This impermeability is achieved by fabricating section 14 as a solid block, although some embodiments may employ a central section with one or more enclosed hollow regions, or rear depressions. Club head 12 may be a single metal casting or a single unit molded from plastics or other materials. In some embodiments various parts of club head 12 may be discretely fabricated and connected together by means of welding, adhesives, fasteners, riveting, or other means.

To facilitate an understanding of the principles associated with the apparatus of FIGS. 1-3, its operation will be briefly described. To begin, a player will grasp the upper end of shaft 10 in the normal fashion and will take the usual stance, addressing the ball. At this time the striking face 14A will be perpendicular to the desired travel path and will be next to ball B. The player will point alignment mark 32C to the desired destination. The player will also position club head 12 so that gauge marks 32A and 32B will be aligned to straddle ball B as shown in FIG. 2.

Next, the player will move club head 12 away from ball B along the direction indicated by alignment mark 32C. In this instance the player will keep club head 12 in a vertical travel plane V (FIG. 3) that intersects ball B and the desired travel path of the ball. Striking face 14A will remain centered on and perpendicular to vertical travel plane V. When this backswing is finished, the player will move club head 12 forward, again keeping striking face 14A centered on and perpendicular to the foregoing vertical travel plane V. Alignment mark 32C may be used as a guide indicating the correct direction of motion for club head 12.

Flanking sections 16 and 18 will simultaneously move forward with striking face 14A. If striking face 14A remains perpendicular to the travel path of club head 12 while traveling through the vertical travel plane V, channels 20 and 22 will be aligned with the travel path of the club head. Accordingly, air impacting striking face 14A will enter channels 20 and 22 directly, without deflecting, and without applying a torque to club head 12. This is the stable orientation for club head 12 when moving.

If however, striking face 14A is skewed azimuthally relative to the travel direction of club head 12, then air entering channels 20 and 22 will be deflected upon entering the channels. This is an unstable condition which will apply torque to club head 12 about a vertical axis (an axis that is perpendicular to channels 20 and 22 and that also perpendicularly bisects a line connecting the centers of mass of flanking sections 16 and 18). This torque will tend to rotate club head 12 to align channels 20 and 22 with the club head's direction of travel, thereby making striking face 14A perpendicular to this direction of travel.

Because flanking sections 16 and 18 are at a relatively large distance from each other, the torque applied to vertical axis between them is commensurately great. Consequently, club head 12 will be turned toward an optimal orientation for striking ball B. In addition, this stabilizing torque will tend to restrict perturbations in the orientation of club head 12 that may be caused by a golfer whose hands may shake.

If on the other hand, striking face 14A is skewed with a small angle of elevation (or declination) relative to the direction of head travel, then air entering channels 20 and 22 will be deflected upon entering the channels to produce a torque that will tend to rotate club head 12 elevationally to align channels 20 and 22 with the club head's direction of travel. This rotation will tend to make striking face 14A perpendicular to this direction of travel.

In many cases a golfer's tight grip will prevent rotation of the club head 12 to align channels 20 and 22 with the direction of travel of the club head. Nevertheless, the golfer will feel the misalignment as a torque transmitted up the club shaft 10. Accordingly, this tactile feedback will teach the golfer to adjust his or her swing to maintain the ideal orientation of striking face 14A.

In any event, the presence of channels 20 and 22 will allow an airflow that will substantially reduce any drag that might have been caused by flanking sections 16 and 18 if those channels were not present. In addition, channels 20 and 22 reduce the mass of flanking sections 16 and 18 so this putter has a fairly natural, balanced feel. Also, the heel to toe curvature of surface 13 reduces the likelihood of flanking sections 16 and 18 dragging along the ground and affecting the performance of club head 12.

Ultimately, striking face 14A will hit golf ball B squarely so that the ball is driven in the direction indicated by alignment mark 32C.

Figure 4:
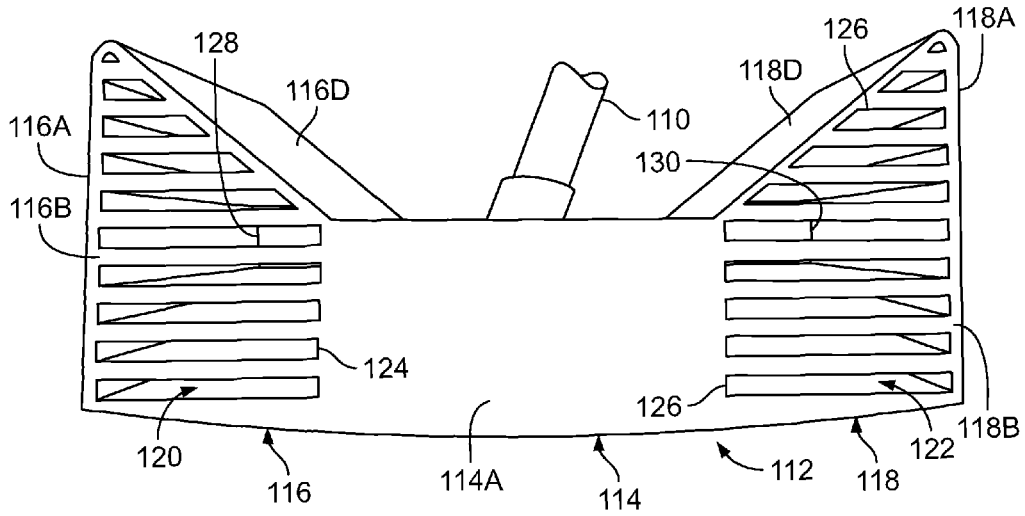
FIG. 4 is a front, perspective view of a golf club that is second embodiment of the present invention.
Figure 5:
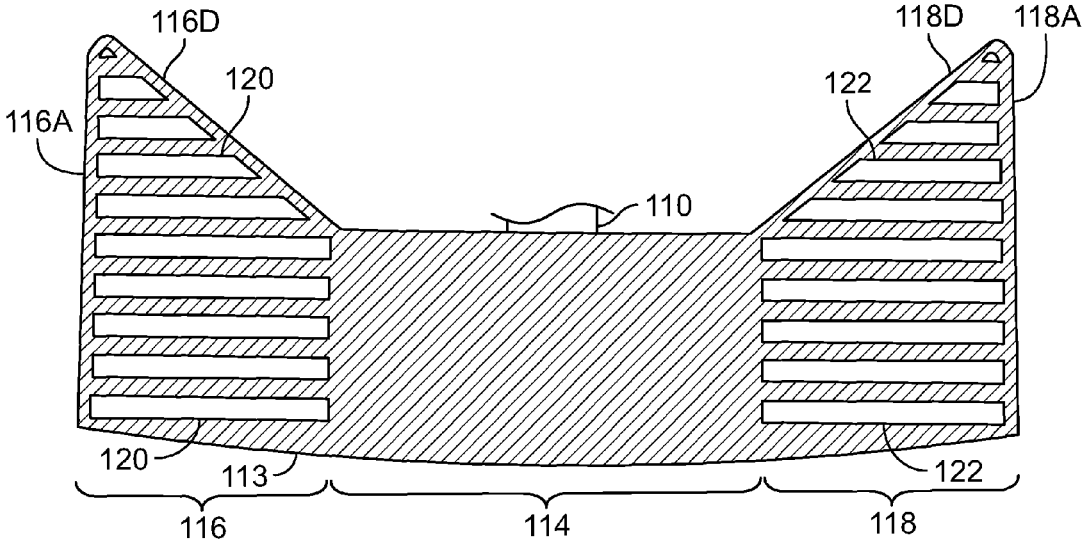
FIG. 5 is a vertical sectional view of the club of FIG. 4 taken along a line much like line 3-3 of FIG. 2.

Referring to FIGS. 4 and 5, the illustrated golf club is another embodiment of the present invention and an alternative to that shown in FIGS. 1-3. The top view of this golf club is the same as that shown in FIG. 2. Components corresponding to those shown in FIGS. 1-3 bear the same reference numerals, but increased by 100.

This golf club is shown with elongated shaft 110 attached at an angle to the top of club head 112 at section 114. Shaft 110 is again, an ordinary golf club shaft typically fitted on the distal end with a gripping sleeve (not shown). Shaft 110 is shown attached at the center of club head 12 (midway between the toe and heel of the club head), but in some embodiments may be offset from the center position. The bottom surface 113 of club head 112 is convexly curved in the toe to heel direction.

Club head 112 has a central section 114 that is flanked on opposite sides by integral flanking sections 116 and 118. Bottom surface 113 extends along sections 114, 116, and 118. The front of central section 114 has a striking face 114A that is wider than a golf ball. In this embodiment striking face 114A has a zero loft angle since this club head 12 is designed as a putter. As before, flanking section 116 (118) has a distal surface 116A (118A) that is upright. Proximal surface 116D (118D) of section 116 (118) is slanted and upwardly diverges from central section 114. The overall dimensions and external shape of club head 112 is substantially the same as previously shown in FIGS. 1-3.

Flanking sections 116 and 118 are perforated by a number of straight, parallel channels 120 and 122, respectively. Unlike the previous embodiment, channels 120 (122) are a single column of uniform slots having rectangular inlets 124 (126) that lead to rectangular outlets 128 (130). Inlets 124 are stacked in a number of equidistantly spaced rows, with the bottom five rows having the same width and having a uniform rectangular cross section. The upper five rows have a similar pattern except that their proximal sides are cut short and slanted because of the slanting of surface 116D. Because of the incursion of surface 16D, the four highest inlets 24 running near surface 116D are progressively truncated. The uppermost channel 120 (122) is highly truncated and has a pie-shaped cross section.

In any event, in this embodiment channels 120 and 122 will have a constant cross-section throughout and will be perpendicular to striking surface 114A. It will be understood that channels 122 of section 118 are arranged as the mirror image of channels 120 of section 116. In fact section 118 is the mirror image of section 116.

In this embodiment the height of channels 120 and 122 is 3/16 inch (5 mm) with a channel to channel, vertical spacing of twice that amount, although different dimensions may be employed in other embodiments. In arrangements of this type, it is desirable to have a reasonable number of channels, and good results are achieved when five or more slots are used in each flanking section. In this embodiment channels 220 occupy approximately 45% of the cross-sectional area of flanking section 116, and their inlets 124 occupy approximately 45% of the area of surface 116B. Flanking section 118 has the same proportion of coverage. In other embodiments the channels and their inlets/outlets may occupy 20% to 75% of the associated cross-sectional area and surface area of the flanking sections.

Unlike flanking sections 116 and 118, central section 114 is distinguished by being impervious to internal airflow that could travel inside central section 114 from front to back. This impermeability is achieved by fabricating section 114 as a solid block, although some embodiments may employ a central section with one or more enclosed hollow regions, or rear depressions.

When this golf club is used, the player will address the ball as before, using any gauge or alignment marks atop central section 114 (see as an example, FIG. 2). Next, the player will move club head 112 away from the ball B.

Unlike the swing in the previous example, this player will swing club head 112 in an arc along an inclined plane before returning the club head along the same arc. Consequently, striking face 114A tends to open on the backswing, close on the downswing, and then, ideally, strike the ball at a central "sweet spot" with the club face perpendicular to the desired trajectory of the ball.

If striking face 114A remains perpendicular to the travel path of club head 112, channels 120 and 122 will be aligned with this travel path. Accordingly, air impacting striking face 114A will enter channels 120 and 122 directly, without deflecting, and without applying a torque to club head 112. This is the stable orientation for club head 112 when moving.

If however, striking face 114A is skewed azimuthally or elevationally relative to the travel direction of club head 112, then air entering channels 120 and 122 will be deflected upon entering the channels. This is an unstable condition which will apply torque to club head 112 that will tend to rotate it to align channels 120 and 122 with the club head's direction of travel, thereby making striking face 114A perpendicular to this direction of travel. If the golfer's tight grip prevents realignment, the golfer will feel the imbalance and will learn to adjust his or her swing.

Again, the presence of channels 120 and 122 will reduce the mass of flanking sections 116 and 118 and will allow an airflow that will substantially reduce any drag that might have occurred if the sections lacked channels. Because the percentage of area occupied by channels 120 and 122 is greater than the prior embodiment, the drag and mass is significantly less.

Figure 6:
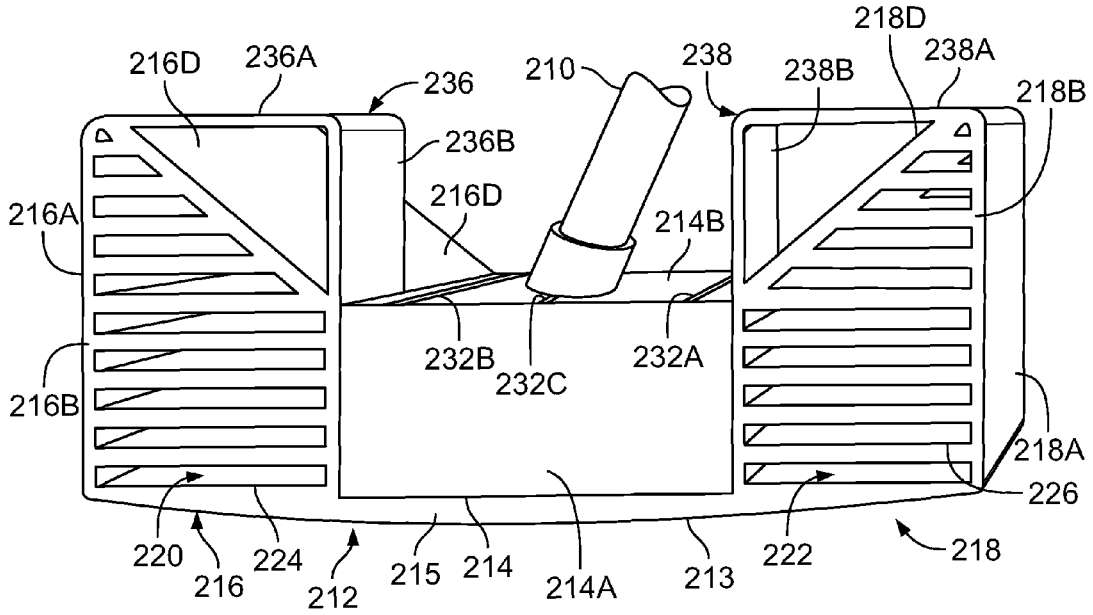
FIG. 6 is a front, perspective view of a golf club that is a third embodiment of the present invention.
Figure 7:
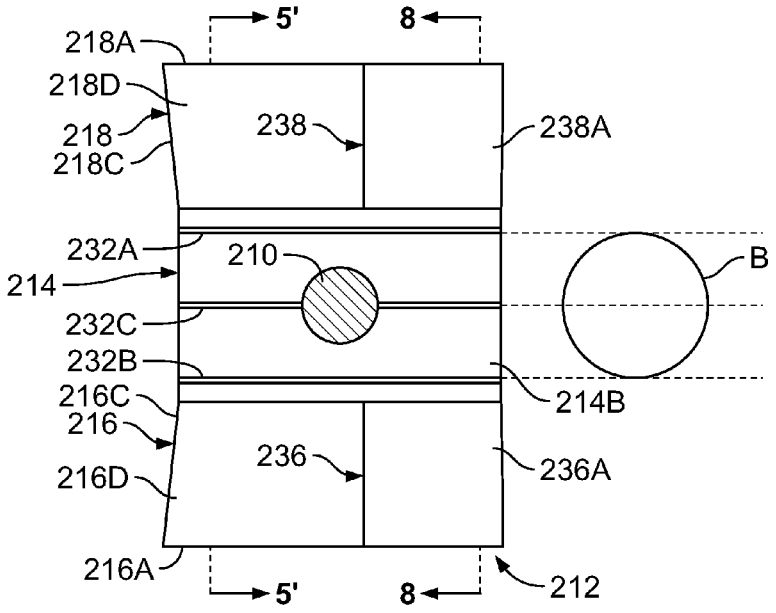
FIG. 7 is a top view of the golf club of FIG. 6.
Figure 8:
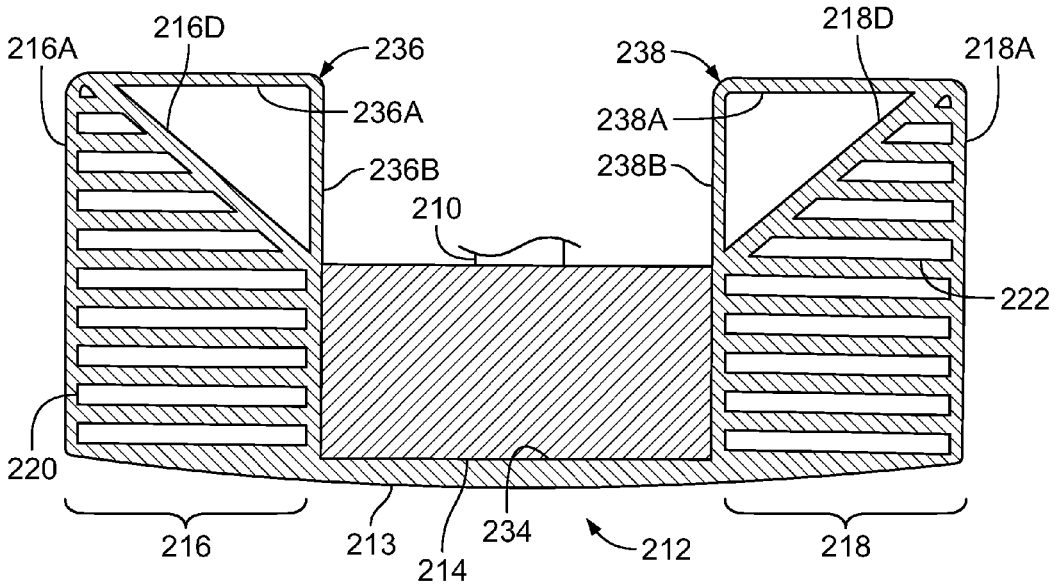
FIG. 8 is a vertical sectional view taken along line 8-8 of FIG. 7.

Referring to FIGS. 6-8, the illustrated golf club is another embodiment of the present invention and an alternative to those previously described Components corresponding to those shown in FIGS. 1-3 bear the same reference numerals, but increased by 200 (or as shown in FIGS. 4-5, but increased by 100). The cross-section along line 5'-5' of FIG. 7 has the same appearance as the cross-section of previously mentioned FIG. 5 (although FIG. 5 does not have matching reference numerals, but reference numerals that differ by 100, as just mentioned).

This golf club is shown with elongated shaft 210 attached at an angle to the top of club head 212 at section 214. Shaft 210 is again, an ordinary golf club shaft typically fitted on the distal end with a gripping sleeve (not shown). Shaft 210 is shown attached at the center of club head 212 (midway between the toe and heel of the club head), but in some embodiments may be offset from the center position. The bottom surface 213 of club head 212 is convexly curved in the toe to heel direction.

Club head 212 has flanking sections 216 and 218 that are interconnected by an integral bridge 215. Central section 214 rests on bridge 215 and the right and left ends of section 214 are flush with flanking sections 216 and 218. Section 214 is held in place by welding, although it can be secured in other embodiments by gluing, riveting, dovetail joints, or other means. The underside of bridge 215 and sections 216 and 218 are convexly curved in a toe to heel direction.

The front of central section 214 has a striking face 214A that is wider than a golf ball. In this embodiment striking face 214A has a zero loft angle since club head 212 is designed as a putter. As before, flanking section 216 (218) has a distal surface 216A (218A) that is upright. Proximal surface 216D (218D) of section 216 (218) is slanted and upwardly diverges from central section 214.

Flanking sections 216 and 218 are perforated by a number of straight, parallel channels 220 and 222, respectively. Channels 220 and 222 are substantially the same as previously shown in FIGS. 4 and 5. Unlike flanking sections 216 and 218, central section 214 is distinguished by being impervious to internal airflow that could travel inside central section 214 from front to back. This impermeability is achieved by fabricating section 214 as a solid block, although some embodiments may employ a central section with one or more enclosed hollow regions, or rear depressions.

Flanking sections 216 and 218 differ from those shown in the previous embodiments by having upper air conduits 236 and 238. Conduit 236 (238) is bordered below by slanted surface 216D (218D), above by top wall 236A (238A), and on the inside by inside wall 236B (238B). Walls 236A and 236B are perpendicular and encompass a passage that is shaped as a triangular prism, which extends approximately over the front two-fifths of slanted surface 216D. Walls 238A and 238B are perpendicular and encompass a passage that is shaped as a triangular prism, which extends approximately over the front two-fifths of slanted surface 218D.

Except for conduits 236 and 238, the overall dimensions and external shape of club head 212 is substantially the same as previously shown in FIGS. 1-3. Also, the flanking section 218 and conduit 238 is the mirror image of section 216 and conduit 236.

This golf club is used substantially the same as previously described. In particular, channels 220 and 222 will provide the stabilizing effect described previously in connection with FIGS. 4-5. Conduits 236 and 238 will guide the passage of air over the top of club head 212. Air passing over club head 212 will be partitioned into airflow through conduit 236, airflow through conduit 238, and airflow between these two conduits. This partitioning will regulate the airflow, reduce turbulence, and generally add to the stability of club head 212 when traveling. Conduits 236 and 238 will achieve these benefits without significantly increasing drag or adding to the mass of the club head 212.

Figure 9:
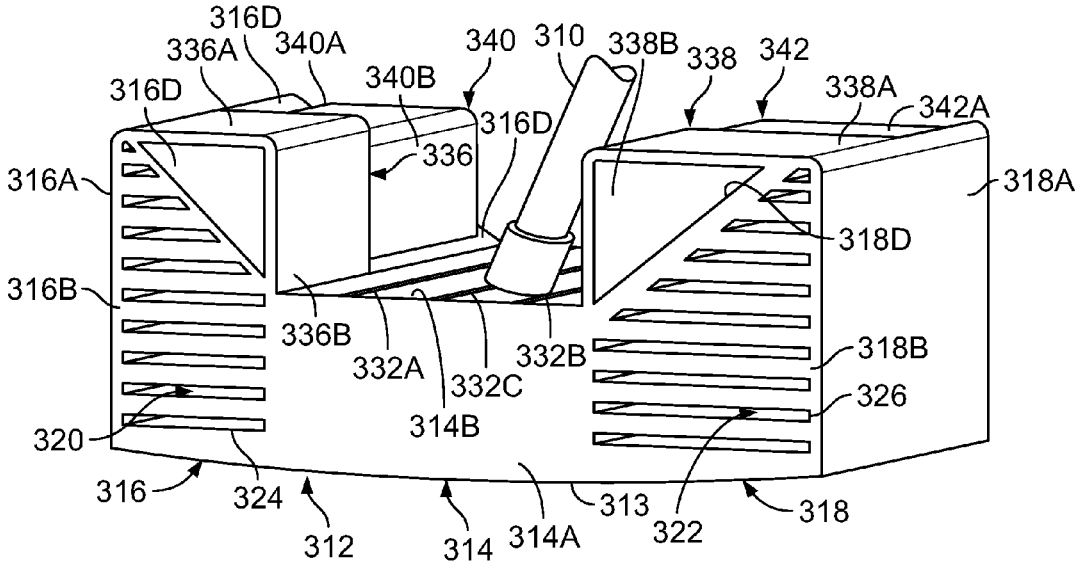
FIG. 9 is a front, perspective view of a golf club that is a fourth embodiment of the present invention.
Figure 10:
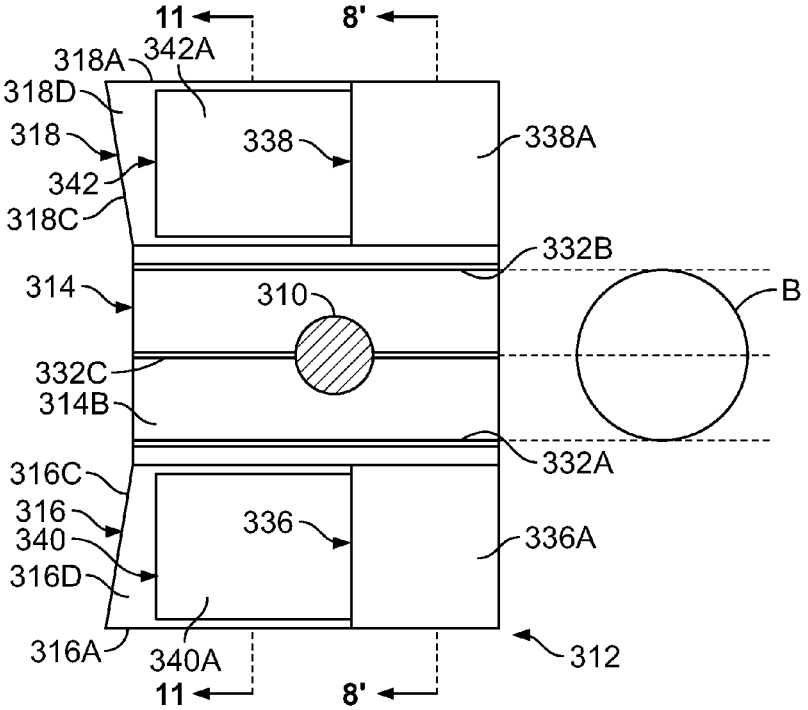
FIG. 10 is a top view of the golf club of FIG. 9.
Figure 11:
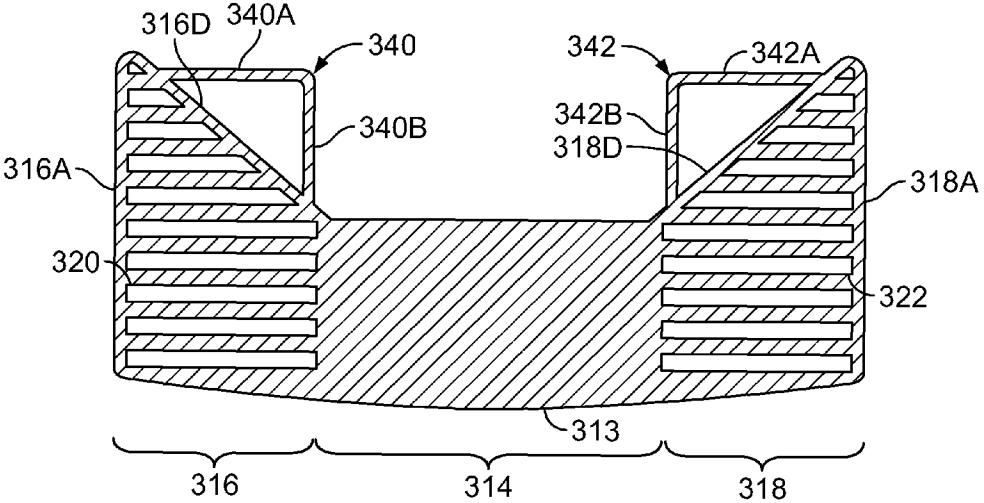
FIG. 11 is a vertical sectional view taken along line 11-11 of FIG. 10, and a vertical sectional view taken along line 8'-8' of FIG. 10 being the same as shown in FIG. 8.

Referring to FIGS. 9-11, the illustrated golf club is another embodiment of the present invention and is an alternative to those previously described. Components corresponding to those shown in FIGS. 1-3 bear the same reference numerals, but increased by 300 (or as shown in FIGS. 6-8, but increased by 100).

This golf club is shown with elongated shaft 310 attached at an angle to the top of club head 312 at central section 314. Shaft 310 is again, an ordinary golf club shaft typically fitted on the distal end with a gripping sleeve (not shown). Shaft 310 is shown attached at the center of club head 312 (midway between the toe and heel of the club head), but in some embodiments may be offset from the center position. The bottom surface 313 of club head 312 is convexly curved in the toe to heel direction.

Central section 314 is between flanking sections 316 and 318. The front of central section 314 has a striking face 314A that is wider than a golf ball, and has a zero loft angle since club head 312 is designed as a putter. As before, flanking section 316 (318) has a distal surface 316A (318A) that is upright. Proximal surface 316D (318D) of section 316 (318) is slanted and upwardly diverges from central section 314.

Flanking sections 316 and 318 are perforated by a number of straight, parallel channels 320 and 322, respectively. Channels 320 and 322 are substantially the same as previously shown in FIGS. 6-8. Unlike flanking sections 316 and 318, central section 314 is distinguished by being impervious to internal airflow that could travel inside central section 314 from front to back.

Flanking sections 316 and 318 differ from those shown in the embodiments of FIGS. 6-8 by including upper posterior air conduits 340 and 342, immediately following and communicating with anterior air conduits 336 and 338, respectively. Anterior conduit 336 (338) is similar to conduit 236 (238) of FIG. 6, and is bordered below by slanted surface 316D (318D), above by top wall 336A (338A), and on the inside by inside wall 336B (338B). Walls 336A and 336B are perpendicular and encompass a passage that is shaped as a triangular prism, which extends approximately over the front two-fifths of slanted surface 316D. Walls 338A and 338B are also perpendicular and encompass a passage that is shaped as a triangular prism, which extends approximately over the front two-fifths of slanted surface 318D.

Posterior conduit 340 (342) is similar to anterior conduit 336 (338), and is bordered below by slanted surface 316D (318D), above by top wall 340A (342A), and on the inside by inside wall 340B (342B). Walls 340A and 340B are perpendicular and encompass a passage that is approximately 25% longer than that of anterior conduit 336. The internal cross-sections of the triangular passages of conduits 336 and 340 are identical, even though the outside dimensions of walls 340A and 340B are smaller, because walls 340A and 340B are thinner than walls 336A and 336B.

Walls 342A and 342B are perpendicular and encompass a passage that is approximately 25% longer than that of anterior conduit 338. The triangular passages of conduits 338 and 342 are identical, even though the outside dimensions of walls 342A and 342B are smaller, because walls 342A and 342B are thinner than walls 338A and 338B.

Except for conduits 340, and 342, the overall dimensions and external shape of club head 312 is substantially the same as previously shown in FIGS. 6-8. Also, the flanking section 318 with its conduits 338 and 342 is the mirror image of section 316 with its conduits 336 and 340.

This golf club is used substantially the same as previously described. In particular, channels 320 and 322 will provide the stabilizing effect (or tactile feedback) described previously in connection with FIGS. 4-5.

Conduits 336, 340, 338, and 342 will guide the passage of air over the top of club head 312. Air passing over club head 312 will be partitioned into airflow through conduits 336 and 340, airflow through conduits 338 and 342, and airflow between these conduits. This partitioning will regulate the airflow, reduce turbulence, and generally add to the stability of club head 312 when traveling. Conduits 336, 340, 338, and 342 will achieve these benefits without significantly increasing drag or adding to the mass of the club head 312.

Figure 12:
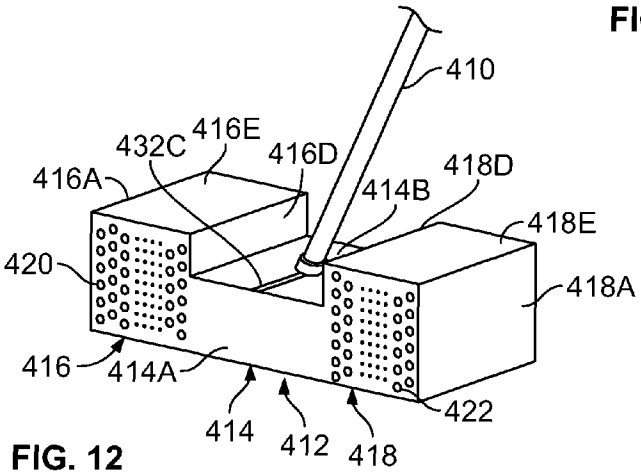
FIG. 12 is a front, perspective view of a golf club that is a fifth embodiment of the present invention.

Referring to FIG. 12, the illustrated golf club is another embodiment of the present invention and is an alternative to those previously described. Components corresponding to those shown in FIGS. 1-3 bear the same reference numerals, but increased by 400.

This golf club is shown with elongated shaft 410 attached at an angle to the top of club head 412 at central section 414. Shaft 410 is again, an ordinary golf club shaft typically fitted on the distal end with a gripping sleeve (not shown). Shaft 410 is shown attached at the center of club head 412 (midway between the toe and heel of the club head), but in some embodiments may be offset from the center position.

Central section 414 is between flanking sections 416 and 418. The front of central section 414 has a striking face 414A that is wider than a golf ball, and has a zero loft angle since club head 412 is designed as a putter. Top surface 414B has only an alignment mark 432C (no gauge marks).

Flanking section 416 (418) has a distal surface 416A (418A) that is upright. Proximal surface 416D (418D) of section 416 (418) is upright and parallel to surface 416A (418A). Top surface 416E (418E) is perpendicular to proximal surface 416D (418D).

Basically sections 414, 416, and 418 are rectangular blocks with the same depth and a common planar underside. Section 414 is wider and shorter than sections 416 and 418. The overall width and depth of club 412 is substantially the same as club 12 of FIG. 1, although the overall height is slightly less in the FIG. 12 embodiment. The fronts of sections 414, 416, and 418 are coplanar, and the same can be said of their rear faces.

The flanking sections 416 and 418 are perforated by a number of straight, parallel channels 420 and 422, respectively. Channels 420 and 422 are straight, parallel, uniform, and cylindrical bores. Channels 420 (as well as channels 422) are arranged in fourteen rows of six channels each. Successive rows are staggered. In this embodiment channels 420 and 422 will have a constant cross-section throughout and will be perpendicular to striking surface 414A. It will be understood that channels 422 of section 418 are arranged as the mirror image of channels 420 of section 416. In fact section 418 is the mirror image of section 416.

In this embodiment the diameters of channels 420 and 422 are 3⁄16 inch (5 mm), although different diameters may be employed with a corresponding adjustment of the number and spatial density of the channels. When relatively small channels are employed they will be distributed with a plurality of them distributed horizontally and a plurality distributed vertically. In such arrangements it is desirable to have a reasonable number of channels, and good results are achieved when twenty or more channels are used in each flanking section.

In this embodiment channels 420 (420) occupy approximately 28% of the cross-sectional area of flanking section 416 (418). In other embodiments the channels and their inlets/outlets may occupy 20% to 75% of the associated cross-sectional area of the flanking sections.

Unlike flanking sections 416 and 418, central section 414 is distinguished by being impervious to internal airflow that could travel inside central section 414 from front to back.

This golf club is used substantially the same as previously described. In particular, channels 420 and 422 will provide the stabilizing effect and tactile feedback described previously in connection with FIGS. 1-3. Channels 420 and 422 will achieve these benefits without significantly increasing drag or adding to the mass of the club head 412.

Figure 13:
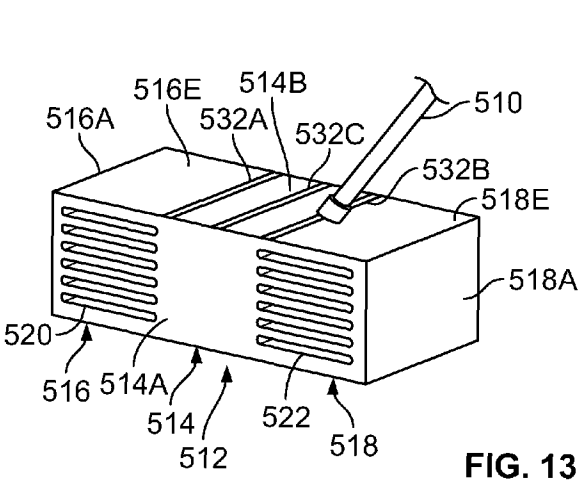
FIG. 13 is a front, perspective view of a golf club that is a sixth embodiment of the present invention.

Referring to FIG. 13, the illustrated golf club is another embodiment of the present invention and is an alternative to those previously described. Components corresponding to those shown in FIGS. 4-5 bear the same reference numerals, but increased by 400.

This golf club is shown with elongated shaft 510, an ordinary golf club shaft. Shaft 510 is shown attached atop club head 512, near the juncture of central section 514 and flanking 518. Central section 514 is between flanking sections 516 and 518. Section 514 is wider than sections 516 and 518. The front of central section 514 has a striking face 514A that is wider than a golf ball, and has a zero loft angle since club head 512 is designed as a putter.

Top surface 514B has an alignment mark 532C, and gauge marks 532A and 532B, similar to those shown previously. Flanking section 516 (518) has a distal surface 516A (518A) that is upright.

Basically, sections 514, 516, and 518 are rectangular blocks with the same depth and height, a common planar underside, and a common planar topside. The fronts of sections 514, 516, and 518 are coplanar, and the same can be said of their backs. In fact, sections 514, 516, and 518 may be considered a single rectangular block.

Flanking sections 516 and 518 are perforated by a number of straight, parallel channels 520 and 522, respectively. Channels 520 (522) are a single column of uniform slots that are stacked in six equidistantly spaced rows, each having the same width and having a uniform rectangular cross section. In this embodiment channels 520 and 522 will have a constant cross-section throughout and will be perpendicular to striking surface 514A. It will be understood that channels 522 of section 518 are arranged as the mirror image of channels 520 of section 516. In fact section 518 is the mirror image of section 516.

In this embodiment the height of channels 120 and 122 is ¼ inch (6.3 mm) with a vertical, channel to channel spacing of twice that amount, although different dimensions may be employed in other embodiments.

In arrangements of this type, it is desirable to have a reasonable number of channels, and good results are achieved when five or more slots are used in each flanking section. In this embodiment channels 520 occupy approximately 45% of the cross-sectional area of flanking section 516. Flanking section 518 has the same proportion of coverage. In other embodiments the channels and their inlets/outlets may occupy 20% to 75% of the associated cross-sectional area of the flanking sections.

Unlike flanking sections 516 and 518, central section 514 is distinguished by being impervious to internal airflow that could travel inside central section 514 from front to back.

This golf club is used substantially the same as previously described. In particular, channels 520 and 522 will provide the stabilizing effect and tactile feedback described previously in connection with FIGS. 4-5. Channels 520 and 522 will achieve these benefits without significantly increasing drag or adding to the mass of the club head 512.

It will be appreciated that various modifications may be implemented with respect to the above described embodiments. Instead of round or slotted channels, some embodiments may use channels with a cross-section that is polygonal, oval, crescent-shaped, or shaped otherwise. In some embodiments the size of the channel can converge or diverge in the front to back direction. In some cases, channels with a variety of shapes can be used in the same club head. While all the disclosed channels were parallel to the intended direction of ball travel, in some embodiments the channels can be angled with the angle of those on the left complementary to those on the right to maintain stability and balance. In some cases the channels can have a curved path with the curvature on the right and on the left complementary to maintain stability and balance. In some embodiments the channels can be converging or diverging from each other. Instead of flat surfaces, the surface of the central and flaking sections can be curved in a variety of ways. Also, the flanking sections can be made of a different material than the central section. While a putter was described, the foregoing club head could be modified to function as an iron, wood, driver, wedge, etc. In those cases the club head may have an upward loft angle.

Obviously, many modifications and variations of the present invention are possible in light of the above teachings. It is therefore to be understood that within the scope of the appended claims, the invention may be practiced otherwise than as specifically described.

The invention claimed is:

1. An aerodynamic golf club comprising:

an elongated shaft having a longitudinal axis; and a club head connected to the elongated shaft, the club head having an overall height and an overall width greater than the overall height, the club head having a central section and contiguous thereto a separated pair of flanking sections on opposite sides of the central section, the central section having an exposed upper surface, an exposed lower surface, a striking face in front and a rear surface in back, the pair of flanking sections each having a top, a bottom, a leading face in front, and a trailing surface in back, the leading face of each of the flanking sections having a plurality of inlets, the trailing surface of each of the flanking sections having a plurality of outlets, the pair of flanking sections each having a plurality of distinct channels distributed in a pattern extending from a position adjacent the top to a position adjacent the bottom of each of the pair of flanking sections, the patterns of the pair of flanking sections both having a height that is greater than the exposed upper surface of the central section, each of the plurality of distinct channels tunneling from a corresponding one of the plurality of inlets to an associated one of the plurality of outlets to provide an air shaft that is open on opposite ends and enclosed 360° along its length, the exposed top surface and the exposed bottom surface of the central section each extending out to the pair of flanking sections, the central section being impervious between its top surface and its bottom surface to internal airflow, the central section being impervious to internal airflow at the striking surface and above and below the striking surface, the plurality of distinct channels having in each of the pair of flanking sections a total cross-sectional area that is the same.

2. An aerodynamic golf club according to claim 1 wherein the plurality of distinct channels have a uniform cross-section along most of their lengths.

3. An aerodynamic golf club according to claim 1 wherein the plurality of channels comprise slots.

4. An aerodynamic golf club according to claim 3 wherein for each of the pair of flanking sections the plurality of channels are parallel.

5. An aerodynamic golf club according to claim 4 wherein for each of the pair of flanking sections the plurality of channels are stacked from top to bottom.

6. An aerodynamic golf club according to claim 5 wherein for each of the pair of flanking sections the plurality of channels are at least five in number.

7. An aerodynamic golf club according to claim 1 wherein the central section is wider than a golf ball.

8. An aerodynamic golf club according to claim 1 wherein the plurality of distinct channels are perpendicular to the striking surface.

9. An aerodynamic golf club according to claim 8 wherein for each of the flanking sections, coverage of the leading face by the plurality of inlets is in the range of 20% to 75%.

10. An aerodynamic golf club according to claim 9 wherein the plurality of channels are straight and have cross-sections that are constant from the leading face to the trailing surface.

11. An aerodynamic golf club according to claim 1 wherein the club head has an underside convexly curved from toe to heel.

12. An aerodynamic golf club according to claim 1 the striking face has a loft angle adapted for use in putting.

13. An aerodynamic golf club according to claim 1 wherein each of the pair of flanking sections is taller than the central section.

14. An aerodynamic golf club according to claim 13 wherein each of the pair of flanking sections has a distal and a proximal surface, the proximal surface of each of the pair of flanking sections extending away from the exposed upper surface of the central section at a right angle.

15. An aerodynamic golf club according to claim 13 wherein each of the pair of flanking sections has a distal and a proximal surface, the proximal surfaces of the pair of flanking sections being slanted to upwardly diverge away from the exposed top surface of the central section at oblique angles.

16. An aerodynamic golf club according to claim 1 wherein the elongated shaft is connected to the central section.

17. An aerodynamic golf club according to claim 16 wherein the elongated shaft is connected midway between the pair of flanking sections.

18. An aerodynamic golf club according to claim 16 wherein the central section has one or more indicia.

19. An aerodynamic golf club according to claim 18 the one or more indicia includes a pair of gauge marks that are spaced to indicate ball width, and an alignment mark centered between the gauge marks.

20. An aerodynamic golf club according to claim 1 wherein the plurality of distinct channels of the pair of flanking sections are each equal in number.

* * * * *